US010407626B2

(12) United States Patent
Rana et al.

(10) Patent No.: US 10,407,626 B2
(45) **Date of Patent: *Sep. 10, 2019**

(54) HYDROCARBON SOLUBLE/DISPERSIBLE HEMIFORMALS AS HYDROGEN SULFIDE SCAVENGERS

(71) Applicant: ECOLAB USA Inc., St. Paul, MN (US)

(72) Inventors: Geeta Rana, Missouri City, TX (US); Christopher Thomas Burrell, Houston, TX (US)

(73) Assignee: ECOLAB USA INC., St. Paul, MN (US)

( * ) Notice: Subject to any disclaimer, the term of this patent is extended or adjusted under 35 U.S.C. 154(b) by 166 days.

This patent is subject to a terminal disclaimer.

(21) Appl. No.: 15/235,932

(22) Filed: Aug. 12, 2016

(65) Prior Publication Data

US 2017/0066977 A1 Mar. 9, 2017

Related U.S. Application Data

(60) Provisional application No. 62/215,547, filed on Sep. 8, 2015.

(51) Int. Cl.
*C10G 29/22* (2006.01)

(52) U.S. Cl.
CPC ..... *C10G 29/22* (2013.01); *C10G 2300/202* (2013.01)

(58) Field of Classification Search
CPC ..... C10G 29/22; C10G 29/24; C10G 29/28; C10G 2300/202
See application file for complete search history.

(56) References Cited

U.S. PATENT DOCUMENTS

| | | | | |
|---|---|---|---|---|
| 3,071,433 | A | | 1/1963 | Dunn |
| 3,458,444 | A | | 7/1969 | Shepherd et al. |
| 3,519,691 | A | * | 7/1970 | von Portatius ..... C07C 41/56 560/238 |
| 3,855,210 | A | | 12/1974 | Keller |
| 3,880,784 | A | | 4/1975 | Wagner et al. |
| 3,888,668 | A | | 6/1975 | Keller |
| 4,036,942 | A | | 7/1977 | Sibeud et al. |
| 4,107,106 | A | | 8/1978 | Dunleavy et al. |
| 4,195,151 | A | | 3/1980 | Dunleavy et al. |
| 4,327,092 | A | | 4/1982 | Collington et al. |
| 4,342,756 | A | | 8/1982 | Collington et al. |
| 4,410,436 | A | | 10/1983 | Holstedt et al. |
| 4,412,928 | A | | 11/1983 | Holstedt et al. |
| 4,557,843 | A | | 12/1985 | Holstedt et al. |
| 4,623,474 | A | | 11/1986 | Holstedt et al. |
| 4,627,930 | A | | 12/1986 | Holstedt et al. |
| 4,629,579 | A | | 12/1986 | Jessup et al. |
| 4,629,580 | A | | 12/1986 | Holstedt et al. |
| 4,657,686 | A | | 4/1987 | Holstedt et al. |
| 4,680,127 | A | | 7/1987 | Edmondson |
| 4,724,099 | A | | 2/1988 | Holstedt et al. |
| 4,756,842 | A | | 7/1988 | Holstedt et al. |
| 4,760,133 | A | | 7/1988 | Niwa et al. |
| 4,801,729 | A | | 1/1989 | Holstedt et al. |
| 4,892,670 | A | | 1/1990 | Mendelson |
| 5,213,680 | A | | 5/1993 | Kremer et al. |
| 5,304,361 | A | | 4/1994 | Parisi |
| 5,700,438 | A | | 12/1997 | Miller |
| 6,048,968 | A | | 4/2000 | Etzbach et al. |
| 6,267,913 | B1 | | 7/2001 | Marder et al. |
| 6,544,492 | B1 | | 4/2003 | DeBerry |
| 6,608,228 | B1 | | 8/2003 | Cumpston et al. |
| 7,078,005 | B2 | | 7/2006 | Smith et al. |
| 7,235,194 | B2 | | 6/2007 | Cumpston et al. |
| 7,438,877 | B2 | | 10/2008 | Salma et al. |
| 7,781,187 | B2 | | 8/2010 | Gasper et al. |
| 8,173,635 | B2 | | 5/2012 | Jimenez et al. |
| 8,197,722 | B2 | | 6/2012 | Marder et al. |
| 8,367,697 | B2 | | 2/2013 | Jimenez et al. |
| 8,597,549 | B2 | | 12/2013 | Cumpston et al. |
| 8,734,637 | B2 | | 5/2014 | Taylor |
| 2002/0185634 | A1 | | 12/2002 | Marder et al. |
| 2004/0086443 | A1 | | 5/2004 | Schield et al. |

(Continued)

FOREIGN PATENT DOCUMENTS

| | | | |
|---|---|---|---|
| CA | 1257606 | A | 7/1989 |
| CA | 1283397 | C | 4/1991 |

(Continued)

OTHER PUBLICATIONS

Bakke, Jan M. and Buhaug, Janne B. "Hydrogen Sulfide Scavenging by 1,3,5-Triazinanes. Comparison of the Rates of Reaction." Industrial & Engineering Chemistry Research (2004), vol. 43, pp. 1962-1965.

International Search Report and Written Opinion for International Application No. PCT/US2014/013818, 9 pages (dated May 28, 2014).

International Search Report and Written Opinion for International Application No. PCT/US2016/028534, 12 pages (dated Jun. 30, 2016).

International Preliminary Report on Patentability for International Application No. PCT/US2016/046813, 7 pages (dated Mar. 22, 2018).

(Continued)

*Primary Examiner* — Michelle Stein

(74) *Attorney, Agent, or Firm* — Eric D. Babych; Brinks Gilson & Lione

(57) ABSTRACT

Scavenging compounds and compositions useful in applications relating to the production, transportation, storage, and separation of municipal waste water, hydrocarbons, crude oil, and natural gas among others are disclosed. Also disclosed herein are methods of using the compounds and compositions as scavengers, particularly in applications relating to the production, transportation, storage, and separation of hydrocarbons, crude oil, and natural gas.

13 Claims, No Drawings

(56) References Cited

U.S. PATENT DOCUMENTS

| | | | | |
|---|---|---|---|---|
| 2004/0096382 | A1* | 5/2004 | Smith | C10L 3/10 423/226 |
| 2004/0110984 | A1 | 6/2004 | Cumpston et al. | |
| 2007/0154980 | A1 | 7/2007 | Gasper et al. | |
| 2008/0283804 | A1 | 11/2008 | Cumpston et al. | |
| 2009/0291937 | A1 | 11/2009 | Jimenez et al. | |
| 2011/0031165 | A1* | 2/2011 | Karas | C10G 29/22 208/48 AA |
| 2011/0155646 | A1 | 6/2011 | Karas et al. | |
| 2012/0149680 | A1 | 6/2012 | Jimenez et al. | |
| 2013/0172623 | A1 | 7/2013 | Kaplan | |
| 2013/0240409 | A1 | 9/2013 | Subramaniyam | |
| 2013/0274426 | A1 | 10/2013 | Sugiura et al. | |
| 2013/0299734 | A1* | 11/2013 | Yang | C10G 29/22 252/180 |
| 2014/0041893 | A1 | 2/2014 | Adams et al. | |
| 2014/0166282 | A1 | 6/2014 | Martinez et al. | |
| 2014/0166288 | A1 | 6/2014 | Bailey et al. | |
| 2014/0166289 | A1 | 6/2014 | Martinez et al. | |
| 2014/0190870 | A1 | 7/2014 | Lehrer et al. | |
| 2014/0209510 | A1 | 7/2014 | Harrington et al. | |
| 2014/0234191 | A1 | 8/2014 | Laroche et al. | |
| 2015/0175877 | A1* | 6/2015 | Shindgikar | C09K 8/605 507/217 |
| 2017/0066977 | A1 | 3/2017 | Rana et al. | |

FOREIGN PATENT DOCUMENTS

| | | | |
|---|---|---|---|
| CN | 1757796 | A | 4/2006 |
| CN | 1814595 | A | 8/2006 |
| CN | 1309868 | C | 4/2007 |
| CN | 101037541 | A | 9/2007 |
| CN | 100503595 | C | 6/2009 |
| CN | 102993047 | A | 3/2013 |
| CN | 103012199 | A | 4/2013 |
| CN | 103018237 | A | 4/2013 |
| CN | 103691277 | A | 4/2014 |
| CN | 102993047 | B | 9/2014 |
| CN | 103018237 | B | 9/2014 |
| DE | 2729918 | A1 | 1/1979 |
| DE | 3301822 | A1 | 8/1983 |
| DE | 3925256 | A1 | 1/1991 |
| DE | 19820400 | A1 | 11/1999 |
| EP | 411409 | A1 | 2/1991 |
| EP | 955342 | B1 | 7/2001 |
| EP | 1363985 | B1 | 8/2007 |
| EP | 2364768 | A1 | 9/2011 |
| GB | 1107057 | A | 3/1968 |
| GB | 1107244 | A | 3/1968 |
| GB | 2114144 | B | 7/1985 |
| JP | S58129059 | A | 8/1983 |
| JP | H01271416 | A | 10/1989 |
| JP | H03099038 | A | 4/1991 |
| JP | 2000026746 | A | 1/2000 |
| JP | 2006219506 | A | 8/2006 |
| JP | 2009522406 | A | 6/2009 |
| JP | 2011038215 | A | 2/2011 |
| JP | 5441053 | B2 | 3/2014 |
| PL | 144233 | B1 | 4/1988 |
| RU | 2246342 | C1 | 2/2005 |
| RU | 2008122310 | A | 12/2009 |
| RU | 2418036 | C1 | 5/2011 |
| RU | 2009143509 | A | 5/2011 |
| RU | 2470987 | C1 | 12/2012 |
| RU | 2490311 | C1 | 8/2013 |
| WO | WO 98/21521 | A1 | 5/1998 |
| WO | WO 02/051968 | A1 | 7/2002 |
| WO | WO 2007/078926 | A2 | 7/2007 |
| WO | WO 2008/027721 | A1 | 3/2008 |
| WO | WO 2008/155333 | A1 | 12/2008 |
| WO | WO 2014/025577 | A1 | 2/2014 |
| WO | WO 2012/086189 | A1 | 5/2014 |
| WO | WO 2016/100224 | A2 | 6/2016 |

OTHER PUBLICATIONS

International Search Report and Written Opinion for International Application No. PCT/US2017/044099, 11 pages (dated Oct. 26, 2017).

Kozyukov, V.P. and V.F. Mironov. Journal of General Chemistry of the USSR, Translated from Russian. New York: Consultants Bureau, 1982, pp. 1222-1229.

Pudovik et al. Journal of General Chemistry of the USSR, Translated from Russian. New York: Consultants Bureau, 1990, pp. 407-408.

STN search, 60 pages (Mar. 4, 2016).

STN search, 3 pages (Mar. 6, 2018).

CAS Registry No. 120-07-0, entered STN: Nov. 16, 1984, 2 pages.

CAS Registry No. 3077-12-1, entered STN: Nov. 16, 1984, 2 pages.

CAS Registry No. 30525-89-4, entered STN: Nov. 16, 1984, 2 pages.

CAS Registry No. 50-00-0, entered STN: Nov. 16, 1984, 2 pages.

Kreulen, H., et al., "Selective removal of $H_2S$ from sour gases with microporous membranes. Part II. A liquid membrane of water-free tertiary amines," *J Membrane Sci*, 82:185-197 (1993).

Benn, M.H., et al., "Cytotoxic compounds. I. p-(N,N-di-2-chloroethyl)- and p-(N,N-di-2-bromoethylamino)thiophenol," Journal of the Chemical Society, 2800-10 (1958).

Bennett, E. O., "Corrosion inhibitors as preservatives for metal-working fluids—ethanolamines," Lubrication Engineering, 35(3):137-44 (1979).

Bradshaw, Jerald S., "Synthesis of macrocylic acetals containing lipophilic substituents," Tetrahedron, 43(19):4271-6 (1987).

Clerici, A., et al., "A New One-Pot, Four-Component Synthesis of 1,2-Amino Alcohols: TiCl3/t-BuOOH-Mediated Radical Hydroxymethylation of Imines," Organic Letters, 10(21):5063-5066 (2008).

Friedli, A., et al., "A convenient synthetic entry into aldehydes with extended conjugation," Tetrahedron, 53(8):2717-2730 (1997).

Friedli, A., et al., "A convenient synthetic entry into aldehydes with extended conjugation," Tetrahedron, 53(18):6233-6234 (1997).

Guo, C., et al., "Synthesis of new aromatic aldehydes bearing nitrogen mustard derivatives and haloalkylpiperazinyl," Youji Huaxue, 25(3):308-312 (2005).

International Search Report and Written Opinion for International Application No. PCT/US2018/041758, 11 pages (dated Sep. 28, 2018).

Li, F., et al., "Synthesis of γ-N-arylideneaminopropyl-2-methyl-6-phenyl-1,3-dioxa-6-aza-2-silacyclooctanes," Synthetic Communications, 31 (23):3715-3720 (2001).

Ma, H., et al., "A novel synthesis of side-chain electro-optic polyimides with high azo chromophore density," European Polymer Journal, 34(8):1125-1132 (1998).

Massin, J., et al., "Near-Infrared Solid-State Emitters Based on Isophorone: Synthesis, Crystal Structure and Spectroscopic Properties," Chemistry of Materials, 23(3):862-873 (2011).

Nishiyama, T., et al., "Synthesis and NMR spectra of 6-phenyl-5,6,7,8-tetrahydro-4H-1,3,6-dioxazocines," Journal of Heterocyclic Chemistry, 23(1):69-71 (1986).

Shen, S., et al., "Mechanistic study of the oxidation of N-phenyldiethanolamine by bis(hydrogen periodato)argentate(III) complex anion," Transition Metal Chemistry, 32(2):167-171 (2007).

"Sul-free H2S & Acid Gas Eliminator," 6 pages, undated, but to the best of undersigned attorney's belief and knowledge is believed to be prior to the filed of this application.

Yin, D., et al., "Synthesis of a novel organic nonlinear optical molecule MC-FTC," Huaxue Xuebao, 62(5):518-522 (2004).

Zhao, Y., et al., "A highly selective colorimetric chemodosimeter for fast and quantitative detection of hydrogen sulfide," Analyst (Cambridge, United Kingdom), 137(23):5576-5580 (2012).

Zhou, L., et al., "NLO Polymers Containing Anionic Chromophore," Journal of Macromolecular Science, Part A: Pure and Applied Chemistry, A42(10):1423-1434 (2005).

Zhou, L., et al., "Novel crosslinked nonlinear optical materials based on cellulose diacetate," Journal of Applied Polymer Science, 100(4):2832-2837 (2006).

International Search Report and Written Opinion from PCT App. No. PCT/US2016/046813, dated Nov. 23, 2016 (10 pages).

(56) References Cited

OTHER PUBLICATIONS

International Search Report and Written Opinion from PCT App. No. PCT/US2016/046832, dated Nov. 23, 2016 (9 pages).
European Search Report for European Application No. 16783814.3, 8 pages (dated Oct. 2, 2018).

* cited by examiner

HYDROCARBON SOLUBLE/DISPERSIBLE HEMIFORMALS AS HYDROGEN SULFIDE SCAVENGERS

TECHNICAL FIELD

The present disclosure relates generally to scavengers of sulfur-based species, and more particularly to compounds derived from condensing branched alkyl di- and tri-alcohols with aldehydes as scavengers of hydrogen sulfide and/or mercaptans.

BACKGROUND

The removal of sulfur-based species from liquid or gaseous hydrocarbon streams is a long-standing problem in many industries. Hydrogen sulfide is a significant problem in the oil industry, particularly in the drilling, production, transportation, storage, and processing of crude oil, as well as waste water associated with crude oil, naphtha, fuel, and distillate oils. The same problems exist in the natural gas industry.

The presence of sulfur-containing compounds such as hydrogen sulfide can result in the deposition of sulfur containing salts which cause plugging and corrosion of transmission pipes, valves, regulators and other process equipment. Hydrogen sulfide is also toxic and, therefore, desirable to be removed. Even flared natural gas needs to be treated to avoid acid rain generation due to $SO_x$ formation. Also, in the manufactured gas or coke making industries, coal-gas emissions containing unacceptable levels of hydrogen sulfide are commonly produced from destructive distillation of bituminous coal.

Since hydrogen sulfide has an offensive odor, and fluids such as petroleum products and natural gas contain it, such fluids are often called "sour." Treatments to lower hydrogen sulfide are often referred to as "sweetening" processes. When a particular compound is used to remove or lower $H_2S$ and mercaptans, it is called scavenging agent.

Conventional nitrogen-containing scavengers such as triazines cause scaling issues and may cause fouling in refineries. Existing non-nitrogen containing scavengers like acrolein and glyoxal can be used for scavenging hydrogen sulfide, however each has their own undesirable properties. For example, acrolein is toxic, and glyoxal is slow acting.

Despite the availability of scavengers for use in the oil and gas industry, there still exists a need for improved compounds, compositions and methods for removing sulfur-based species from liquid and gas streams. Such improvements include nitrogen-free scavengers and scavengers with increased dispersion into the sour hydrocarbon.

BRIEF SUMMARY

In one aspect, a method of sweetening a fluid is disclosed. The method includes treating the fluid with an oil-soluble hemiformal or hemiacetal of formula (I): (I) $R^1$—O—[—$CHR^2$—O—]$_x$—H; wherein $R^1$ is $C_4$-$C_{30}$ branched alkyl, $C_4$-$C_{30}$ branched alkenyl, $C_5$-$C_{30}$ branched alkynyl, each further substituted with 1-2 hydroxyls, wherein a first hydroxyl is functionalized as —O—[—$CHR^2$—O—]$_y$—H and a second hydroxyl, if present, is functionalized as —O—[—$CHR^2$—O—]$_z$—H; where each x, y, and z is from 1 to 9 and $R^2$ is hydrogen or straight or branched alkyl from 1-9 carbon atoms.

In some embodiments, $R^2$ is hydrogen. In some embodiments, $R^2$ is straight or branched alkyl from 1-9 carbon atoms In some embodiments, x is from 1 to 5. In some embodiments, x is 1. In some embodiments, x is 2. In some embodiments, y is from 1 to 5. In some embodiments, y is 1. In some embodiments, y is 2. In some embodiments, z is from 1 to 5. In some embodiments, z is 1. In some embodiments, z is 2.

In some embodiments, $R^1$ is $C_5$-$C_{20}$ branched alkyl. In some embodiments, $R^1$ is

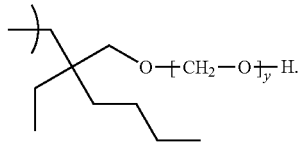

In some embodiments, $R^1$ is

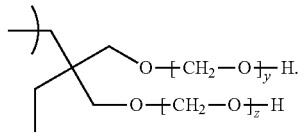

In some embodiments, the method includes adding one or more additional components, each component independently selected from the group consisting of asphaltene inhibitors, paraffin inhibitors, corrosion inhibitors, scale inhibitors, emulsifiers, water clarifiers, dispersants, emulsion breakers, hydrogen sulfide scavengers, gas hydrate inhibitors, biocides, pH modifiers, surfactants, dispersant, solvents, and combinations thereof. In some embodiments, the surfactant or dispersant is selected from the group consisting alkyl benzyl ammonium chloride, benzyl cocoalkyl($C_{12}$-$C_{18}$)dimethylammonium chloride, dicocoalkyl ($C_{12}$-$C_{18}$)dimethyl-ammonium chloride, ditallow dimethylammonium chloride, di(hydrogenated tallow alkyl) dimethyl quaternary ammonium methyl chloride, methyl bis(2-hydroxyethyl cocoalkyl($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, hydrogenated tallow alkyl (2-ethylhyexyl) dimethyl quaternary ammonium methyl sulfate, and combinations thereof.

In some embodiments, the method includes adding an odorant.

In some embodiments, the fluid is produced or used in a coal-fired process, a waste-water process, a farm, a slaughter house, a land-fill, a municipality waste-water plant, a coking coal process, or a biofuel process.

The compounds, compositions, methods and processes are further described herein.

DETAILED DESCRIPTION

Disclosed herein are hydrogen sulfide and/or mercaptan scavenging compounds and compositions, methods of using said compounds and compositions, and processes for their preparation. The compounds and compositions are particularly useful in the control of hydrogen sulfide and/or mercaptan emissions from crude oil based, natural gas based, and coal based products and processes. The compounds and compositions are applicable to both upstream and downstream processes. The scavenging compounds and compositions, optionally blended with aqueous and/or non-aqueous solvents, are useful in a wide range of climates and under a wide range of process conditions.

The disclosed processes for preparing the compounds and compositions of the invention are economic, waste free, and provide said compounds in quantitative yields. In certain embodiments, the compounds and compositions may be obtained in anhydrous form, thereby providing use in processes where it is desirable to minimize water content (e.g., in an oil production process such as those where the oil temperature is greater than 100° C.). Producing the compounds and compositions in anhydrous form also allows for reduced transportation costs. The anhydrous compounds and compositions can optionally be blended with hydrophilic solvents (e.g., alcohols, glycol, polyols) for non-aqueous applications. Alternatively, the compounds and compositions may be blended with an aqueous phase for direct use in aqueous applications.

The compounds and compositions of the invention provide further economic advantages through reduced transportation costs due to increased actives concentration, and through increased production capacity. The compounds and compositions of the invention also considerably lower the water washable nitrogen content to eliminate nitrogen contamination of refinery catalyst beds. The compounds and compositions also provide the ability to manufacture the products at most locations without offensive odor emanating from raw materials.

The compounds and compositions are non-nitrogen-containing, branched, oil/water dispersible hemiformal compounds effective at associating with hydrogen sulfide.

1. Definition of Terms

Unless otherwise defined, all technical and scientific terms used herein have the same meaning as commonly understood by one of ordinary skill in the art. In case of conflict, the present document, including definitions, will control. Various methods and materials are described below, although methods and materials similar or equivalent to those described herein can be used in practice or testing in view of this disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of," the embodiments or elements presented herein, whether explicitly set forth or not.

Unless expressly stated to the contrary, use of the term "a" is intended to include "at least one" or "one or more." For example, "a compound" is intended to include "at least one compound" or "one or more compounds."

As used herein, the term "consisting essentially of" means that the methods and compositions may include additional steps, components, ingredients or the like, but only if the additional steps, components and/or ingredients do not materially alter the basic and novel characteristics of the claimed methods and compositions.

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

The term "alkyl," as used herein, refers to a hydrocarbon radical with a defined number of carbon atoms (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 29, and 30 carbons). Branched alkyl groups include, but are not limited to, sec-butyl, tert-butyl, isobutyl, isopentyl, neopentyl, 1-methylbutyl, 2-methylbutyl, 1,1-dimethylpropyl, 1,2-dimethylpropyl, 1-ethylpropyl, 1-methylpentyl, 2-methylpentyl, 3-methylpentyl, 4-methylpentyl, 1,1-dimethylbutyl, 1,2-dimethylbutyl, 1,3-dimethylbutyl, 2,2-dimethylbutyl, 2,3-dimethylbutyl, 3,3-dimethylbutyl, 1,1,2-trimethylpropyl, 1,2,2-trimethylpropyl, 1-ethylbutyl, 2-ethylbutyl, 1-methylhexyl, 2-methylhexyl, 3-methylhexyl, 4-methylhexyl, 5-methylhexyl, 1,1-dimethylpentyl, 1,2-dimethylpentyl, 1,3-dimethylpentyl, 1,4-dimethylpentyl, 2,2-dimethylpentyl, 2,3-dimethylpentyl, 2,4-dimethylpentyl, 3,3-dimethylpentyl, 3,4-dimethylpentyl, 4,4-dimethylpentyl, 1,1,2-trimethylbutyl, 1,1,3-trimethylbutyl, 1,2,2-trimethylbutyl, 1,2,3-trimethylbutyl, 1,3,3-trimethylbutyl, 2,2,3-trimethylbutyl, 2,3,3-trimethylbutyl, 1,1,2,2-tetramethylpropyl, 1-ethylpentyl, 2-ethylpentyl, 3-ethylpentyl, 1-ethyl-1-methylbutyl, 1-ethyl-2-methylbutyl, 1-ethyl-3-methylbutyl, 2-ethyl-1-methylbutyl, 2-ethyl-2-methylbutyl, 2-ethyl-3-methylbutyl, 1-propylbutyl, 1,1-diethylpropyl, etc. In some embodiments, the number of carbon atoms for the alkyl group is between 4 and 20. In some embodiments, the number of carbon atoms for the alkyl group is between 4 and 15. In some embodiments, the number of carbon atoms for the alkyl group is between 4 and 10. In some embodiments, the number of carbon atoms for the alkyl group is between 4 and 8. In some embodiments, the number of carbon atoms for the alkyl group is between 4 and 6. In some embodiments, the number of carbon atoms for the alkyl group is between 5 and 30. In some embodiments, the number of carbon atoms for the alkyl group is between 5 and 20. In some embodiments, the number of carbon atoms for the alkyl group is between 5 and 15. In some embodiments, the number of carbon atoms for the alkyl group is between 5 and 10. In some embodiments, the number of carbon atoms for the alkyl group is between 5 and 8.

The term "alkenyl," as used herein, refers to hydrocarbon radical, with at least one unit of unsaturation which is a carbon-carbon double bond with a defined number of carbon atoms (i.e., 4, 5, 6, 7, 8, 9, 10, 11, 12, 13, 14, 15, 16, 17, 18, 19, 20, 21, 22, 23, 24, 25, 26, 27, 28, 29, and 30 carbons). Branched alkenyl groups include, but are not limited to, 1-methyl-1-propenyl, 2-methyl-1-propenyl, 1-methyl-2-propenyl, 2-methyl-2-propenyl, 1,3-pentadienyl, 2,4-pentadienyl, 1-methyl-1-butenyl, 2-methyl-1-butenyl, 3-methyl-1-butenyl, 1-methyl-2-butenyl, 2-methyl-2-butenyl, 3-methyl- 2-butenyl, 1-methyl-3-butenyl, 2-methyl-3-butenyl, 3-methyl-3-butenyl, 1,1-dimethyl-2-propenyl, 1-ethyl-1-propenyl, 1-ethyl-2-propenyl 1-ethyl-2-propenyl, 2-ethyl-2-propenyl, 1,3-hexadienyl, 2,4-hexadienyl, 3,5-hexadienyl, 1,3,5-hexatrienyl, 1-methyl-1-pentenyl, 2-methyl-1-pentenyl, 3-methyl-1-pentenyl, 4-methyl-1-pentenyl, 1-methyl-2-pentenyl, 2-methyl-2-pentenyl, 3-methyl-2-pentenyl, 4-methyl-2-pentenyl, 1-methyl-3-pentenyl, 2-methyl-3-pentenyl, 3-methyl-3-pentenyl, 4-methyl-3-pentenyl, 1-methyl-4-pentenyl, 2-methyl-4-pentenyl, 3-methyl-4-pentenyl, 4-methyl-4-pentenyl, 1-methyl-1,3-pentadienyl, 2-methyl-1,3-pentadienyl, 3-methyl-1,3-pentadienyl, 4-methyl-1,3-pentadienyl, 1-methyl-2,4-pentadienyl, 2-methyl-2,4-pentadienyl, 3-methyl-2,4-pentadienyl, 4-methyl-2,4-pentadienyl, 1,2-dimethyl-1-butenyl 1,3-dimethyl-1-butenyl, 2,3-dimethyl-1-butenyl, 3,3-dimethyl-1-butenyl, 1,1-dimethyl-2-butenyl, 1,2-dimethyl-2-butenyl, 1,3-dimethyl-2-butenyl, 2,3-dimethyl-2-butenyl, 1,1-dimethyl-3-butenyl, 1,2-dimethyl-3-butenyl, 1,3-dimethyl-3-butenyl, 2,2-dimethyl-3-butenyl, 2,3-dimethyl-3-butenyl, 1-ethyl-1-butenyl, 2-ethyl-1-butenyl, 1-ethyl-2-butenyl, 2-ethyl-2-butenyl, 1-ethyl-3-butenyl, 2-ethyl-3-butenyl, 1,1,2-trimethyl-2-propenyl, 1,3-heptadienyl, 2,4-heptadienyl, 3,5-heptadienyl, 4,6-heptadienyl, 1,3,5-heptatrienyl, 2,4,6-heptatrienyl, 1-methyl-1-hexenyl, 2-methyl-1-hexenyl, 3-methyl-1-hexenyl, 4-methyl-1-hexenyl, 5-methyl-1-hexenyl, 1-methyl 2-hexenyl, 2-methyl-2-hexenyl, 3-methyl-2-hexenyl, 4-methyl-2-hexenyl, 5-methyl-2-hexenyl, 1-methyl-3-hexenyl, 2-methyl-3-hexenyl, 3-methyl-3-hexenyl, 4-methyl-3-hexenyl, 5-methyl-3-hexenyl, 1-methyl-4-hexenyl, 2-methyl-4-hexenyl, 3-methyl-4-hexenyl, 4-methyl-4-hexenyl, 5-methyl-4-hexenyl, 1-methyl-5-hexenyl, 2-methyl-5-hexenyl, 3-methyl-5-hexenyl, 4-methyl-5-hexenyl, 5-methyl-5-hexenyl, 1-methyl-1,3-hexadienyl, 2-methyl-1,3-hexadienyl, 3-methyl-1,3-hexadienyl, 4-methyl-1,3-hexadienyl, 5-methyl-1,3-hexadienyl, 1-methyl-2,4-hexadienyl, 2-methyl-2,4-hexadienyl, 3-methyl-2,4-hexadienyl, 4-methyl-2,4-hexadienyl, 5-methyl-2,4-hexadienyl, 1-methyl-3,5-hexadienyl, 2-methyl-3,5-hexadienyl, 3-methyl-3,5-hexadienyl, 4-methyl-3,5-hexadienyl, 5-methyl-3,5-hexadienyl, 1-methyl-1,3,5-hexatrienyl, 2-methyl-1,3,5-hexatrienyl, 3-methyl-1,3,5-hexatrienyl, 4-methyl-1,3,5-hexatrienyl, 5-methyl-1,3,5-hexatrienyl, 1,2-dimethyl-1-pentenyl, 1,3-dimethyl-1-pentenyl, 1,4-dimethyl-1-pentenyl, 2,3-dimethyl-1-pentenyl, 2,4-dimethyl-1-pentenyl, 3,3-dimethyl-1-pentenyl, 3,4-dimethyl-1-pentenyl, 4,4-dimethyl-1-pentenyl, 4,5-dimethyl-1-pentenyl, 1,1-dimethyl-2-pentenyl, 1,2-dimethyl-2-pentenyl, 1,3-dimethyl-2-pentenyl, 1,4-dimethyl-2-pentenyl, 2,3-dimethyl-2-pentenyl, 2,4-dimethyl-2-pentenyl, 3,4-dimethyl-2-pentenyl, 4,4-dimethyl-2-pentenyl, 1,1-dimethyl-3-pentenyl, 1,2-dimethyl-3-pentenyl, 1,3-dimethyl-3-pentenyl, 1,4-dimethyl-3-pentenyl, 2,2-dimethyl-3-pentenyl, 2,3-dimethyl-3-pentenyl, 2,4-dimethyl-3-pentenyl, 3,4-dimethyl-3-pentenyl, 1,1-dimethyl-4-pentenyl, 1,2-dimethyl-4-pentenyl, 1,3-dimethyl-4-pentenyl, 1,4-dimethyl-4-pentenyl, 2,2-dimethyl-4-pentenyl, 2,3-dimethyl-4-pentenyl, 2,4-dimethyl-4-pentenyl, 3,3-dimethyl-4-pentenyl, 3,4-dimethyl-4-pentenyl, 1,2-dimethyl-1,3-pentadienyl, 1,3-dimethyl-1,3-pentadienyl, 1,4-dimethyl-1,3-pentadienyl, 2,3-dimethyl-1,3-pentadienyl, 2,4-dimethyl-1,3-pentadienyl, 3,4-dimethyl-1,3-pentadienyl, 4,4-dimethyl-1,3-pentadienyl, 1,1-dimethyl-2,4-pentadienyl, 1,2-dimethyl-2,4-pentadienyl, 1,3-dimethyl-2,4-pentadienyl, 1,4-dimethyl-2,4-pentadienyl, 2,3-dimethyl-2,4-pentadienyl, 2,4-dimethyl-2,4-pentadienyl, 3,4-dimethyl-2,4-pentadienyl, 1,2,3-trimethyl-1-butenyl, 1,3,3-trimethyl-1-butenyl, 2,3,3-trimethyl-1-butenyl, 1,1,2-trimethyl-2-butenyl, 1,1,3-trimethyl-2-butenyl, 1,2,3-trimethyl-2-butenyl, 1,1,2-trimethyl-3-butenyl, 1,1,3-trimethyl-3-butenyl, 1,2,2-trimethyl-3-butenyl, 1,2,3-trimethyl-3-butenyl, 2,2,3-trimethyl-3-butenyl, 1,2,3-trimethyl-1,3-butadienyl, etc. In some embodiments, the number of carbon atoms for the alkenyl group is between 4 and 20. In some embodiments, the number of carbon atoms for the alkenyl group is between 4 and 15. In some embodiments, the number of carbon atoms for the alkenyl group is between 4 and 10. In some embodiments, the number of carbon atoms for the alkenyl group is between 4 and 8. In some embodiments, the number of carbon atoms for the alkenyl group is between 4 and 6. In some embodiments, the number of carbon atoms for the alkenyl group is between 5 and 30. In some embodiments, the number of carbon atoms for the alkenyl group is between 5 and 20. In some embodiments, the number of carbon atoms for the alkenyl group is between 5 and 15. In some embodiments, the number of carbon atoms for the alkenyl group is between 5 and 10. In some embodiments, the number of carbon atoms for the alkenyl group is between 5 and 8.

The term "alkynyl," as used herein, refers to a linear or branched hydrocarbon radical, with at least one unit of unsaturation which is a carbon-carbon triple bond with a defined number of carbon atoms (i.e., 5, 6, 7, 8, 9, 10, 11, 12, 13, 14, 15, 16, 17, 18, 19, 20, 21, 22, 23, 24, 25, 26, 27, 28, 29, and 30 carbons). Branched alkynyl groups include, but are not limited to, 3-methylbut-1-ynyl, 3-methylpent-1-ynyl, 3-methylhex-1-ynyl, 3-ethylpent-1-ynyl, 3-ethylpentyl-ynyl, 4-methylhep2-ynyl, and the like. In some embodiments, the number of carbon atoms for the alkynyl group is between 4 and 20. In some embodiments, the number of carbon atoms for the alkynyl group is between 4 and 15. In some embodiments, the number of carbon atoms for the alkynyl group is between 4 and 10. In some embodiments, the number of carbon atoms for the alkynyl group is between 4 and 8. In some embodiments, the number of carbon atoms for the alkynyl group is between 4 and 6. In some embodiments, the number of carbon atoms for the alkynyl group is between 5 and 30. In some embodiments, the number of carbon atoms for the alkynyl group is between 5 and 20. In some embodiments, the number of carbon atoms for the alkynyl group is between 5 and 15. In some embodiments, the number of carbon atoms for the alkynyl group is between 5 and 10. In some embodiments, the number of carbon atoms for the alkynyl group is between 5 and 8.

The term "sweetening," as used herein, may refer to a process that removes sulfur species from a gas or liquid. The sulfur species may include hydrogen sulfide and mercaptans.

The term "sour gas," as used herein, may refer to a gas that includes significant amounts of sulfur species, such as hydrogen sulfide and/or mercaptans.

The term "sour liquid" or "sour fluid," as used herein, may refer to a liquid that includes significant amounts of sulfur species, such as hydrogen sulfide and/or mercaptans.

The term "water cut," as used herein, means the percentage of water in a composition containing an oil and water mixture.

2. Compounds

Compounds disclosed herein include scavengers of sulfur-based species, such as hydrogen sulfide and mercaptans. In one aspect, compounds disclosed herein are of formula (I):

$$R^1—O—[—CHR^2—O—]_x—H \quad (I)$$

wherein $R^1$ is $C_4$-$C_{30}$ branched alkyl, $C_4$-$C_{30}$ branched alkenyl, $C_5$-$C_{30}$ branched alkynyl, each further substituted with 1-2 hydroxyls, wherein a first hydroxyl is functionalized as —O—[—$CH_2$—O—]$_y$—H and a second hydroxyl, if present, is functionalized as —O—[—$CH_2$—O—]$_z$—H. Each x, y, and z is from 1 to 9. $R^2$ is selected from hydrogen and $C_1$-$C_9$ alkyl.

Applicant has found that using branched alkanols having two or three hydroxyl groups, hemiformals of such alkanols result in products that have increased oil solubility over conventional scavengers while still being operable when water is present to scavenge hydrogen sulfide by partitioning into hydrocarbons where the sulfide is present.

The unit [—$CH_2$—O—] represents a formaldehyde (i.e. when $R^2$ is hydrogen and x is 1) and paraformaldehyde (when x is greater than 1). Thus, the molecular weight of the compounds of formula I depends upon both the selection of $R^1$ as well as number of hemiformal units present.

The unit [—$CHR^2$—O—] represents an acetal group when $R^2$ is $C_1$-$C_9$ alkyl.

In some embodiments, x is selected from 1 to 9. In some embodiments, x is from 1 to 5. In some embodiments, x is from 1 to 4. In some embodiments, x is from 1 to 3. In some embodiments, x is from 1 to 2. In some embodiments, x is 1. In some embodiments, x is 2. In some embodiments, x is 3. In some embodiments, x is 4. In some embodiments, x is 5. In some embodiments, x is greater than 5. In some embodiments, x is less than 9.

In some embodiments, y is selected from 1 to 9. In some embodiments, y is from 1 to 5. In some embodiments, y is from 1 to 4. In some embodiments, y is from 1 to 3. In some embodiments, y is from 1 to 2. In some embodiments, y is 1. In some embodiments, y is 2. In some embodiments, y is 3. In some embodiments, y is 4. In some embodiments, y is 5. In some embodiments, y is greater than 5. In some embodiments, y is less than 9.

In some embodiments, z is selected from 1 to 9. In some embodiments, z is from 1 to 5. In some embodiments, z is from 1 to 4. In some embodiments, z is from 1 to 3. In some embodiments, z is from 1 to 2. In some embodiments, z is 1. In some embodiments, z is 2. In some embodiments, z is 3. In some embodiments, z is 4. In some embodiments, z is 5. In some embodiments, z is greater than 5. In some embodiments, z is less than 9.

In some embodiments, $R^1$ is branched $C_5$-$C_{20}$ alkyl. In some embodiments, $R^1$ is branched $C_5$-$C_{15}$ alkyl. The alkyl branching is not located geminal to the carbon with the hydroxyl group.

In some embodiments, $R^1$ is

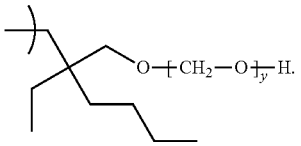

In some embodiments, $R^1$ is

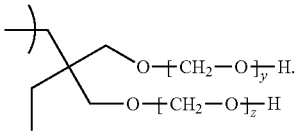

In some embodiments, $R^1$ is $C_4$-$C_{30}$ branched alkenyl. In some embodiments, $R^1$ is $C_5$-$C_{30}$ branched alkynyl.

In some embodiments, the compounds of formulas I and II are not corrosive to steel, and other iron alloys.

In some embodiments, $R^2$ is hydrogen. In some embodiments, $R^2$ is $C_1$ alkyl group. In some embodiments, $R^2$ is $C_2$ alkyl group. In some embodiments, $R^2$ is $C_3$ alkyl group. In some embodiments, $R^2$ is $C_4$ alkyl group. In some embodiments, $R^2$ is $C_5$ alkyl group. In some embodiments, $R^2$ is $C_6$ alkyl group. In some embodiments, $R^2$ is $C_7$ alkyl group. In some embodiments, $R^2$ is $C_8$ alkyl group. In some embodiments, $R^2$ is $C_9$ alkyl group.

The compounds of formula I are prepared by mixing an alcohol of the formula $R^1$—OH, where $R^1$ is a branched alkyl, branched alkenyl, or branched alkynyl group having one to three hydroxyl groups, with formaldehyde or a $C_1$-$C_{10}$ aldehyde. The resulting branched alcohol formaldehyde and aldehyde addition products may be provided in anhydrous or hydrous form in the presence of an acid catalyst, such as dodecyl benzene sulfonic acid. The resulting hemiformal may have a single hemiformal unit where a single unit of formaldehyde reacts with each hydroxyl group or multiple hemiformal units where multiple units of formaldehyde react with each hydroxyl group and resulting hemiformals. The resulting hemiacetal may have a single hemiacetal unit where a single unit of $C_1$-$C_{10}$ aldehyde reacts with each hydroxyl group or multiple hemiacetal units where multiple units of $C_1$-$C_{10}$ aldehyde react with each hydroxyl group and resulting hemiacetals.

3. Compositions

The compositions disclosed herein include at least one compound as described above but can also include mixtures of compounds described herein.

The compositions can be prepared by adding from about 1 to about 3 moles of the branched alkanol to a reaction flask. The flask may be equipped with a magnetic stirrer, a nitrogen inlet, and a temperature probe. Optionally, the flask may be heated during reaction, for example between about 60° C. and 80° C. Optionally, nitrogen gas may be passed over the reaction mixture throughout the reaction. An amount of base, such as between about 0.001 and about 0.035 moles of potassium hydroxide in aqueous solution (e.g. 45%) may be added to the reaction flask. After a period of time, for example 20 minutes, about 1 to about 3 moles of paraformaldehyde prills (or formaldehyde) may be added to the reaction mixture. Prills may be added all at once or in batch-wise steps.

In some embodiments, a composition comprises from about 20 to about 100 percent by weight of one or more compounds disclosed herein, or from about 20 to about 98 percent by weight of one or more compounds disclosed herein, or from about 50 to 97 percent by weight of one or more compounds disclosed herein.

The compositions disclosed herein can optionally include one or more additives.

Suitable additives include, but are not limited to, asphaltene inhibitors, paraffin inhibitors, corrosion inhibitors, scale inhibitors, emulsifiers, water clarifiers, dispersants, emulsion breakers, hydrogen sulfide scavengers, gas hydrate inhibitors, biocides, pH modifiers, surfactants, solvents, and combinations thereof.

a. Asphaltene Inhibitors

Suitable asphaltene inhibitors include, but are not limited to, aliphatic sulphonic acids; alkyl aryl sulphonic acids; aryl sulfonates; lignosulfonates; alkylphenol/aldehyde resins and similar sulfonated resins; polyolefin esters; polyolefin imides; polyolefin esters with alkyl, alkylenephenyl or alkylenepyridyl functional groups; polyolefin amides; polyolefin amides with alkyl, alkylenephenyl or alkylenepyridyl functional groups; polyolefin imides with alkyl, alkylenephenyl or alkylenepyridyl functional groups; alkenyl/vinyl pyrrolidone copolymers; graft polymers of polyolefins with maleic anhydride or vinyl imidazole; hyperbranched polyester amides; polyalkoxylated asphaltenes, amphoteric fatty acids, salts of alkyl succinates, sorbitan monooleate, polyisobutylene succinic anhydride, and combinations thereof. The amount of asphaltene inhibitor present in the composition is not particularly limited and may be selected by one of ordinary skill in the art. In some embodiments, the asphaltene inhibitor may be present in the composition in an amount of about 0 to about 30% by weight of the composition.

b. Paraffin Inhibitors

Suitable paraffin inhibitors include, but are not limited to, paraffin crystal modifiers, and dispersant/crystal modifier combinations. Suitable paraffin crystal modifiers include, but are not limited to, alkyl acrylate copolymers, alkyl acrylate vinylpyridine copolymers, ethylene vinyl acetate copolymers, maleic anhydride ester copolymers, branched polyethylenes, naphthalene, anthracene, microcrystalline wax and/or asphaltenes, and combinations thereof. Suitable paraffin inhibitors also include dodecyl benzene sulfonate, oxyalkylated alkylphenols, oxyalkylated alkylphenolic resins, and combinations thereof. The amount of paraffin inhibitor present in the composition is not particularly limited and may be selected by one of ordinary skill in the art. In some embodiments, the paraffin inhibitor may be present in the composition in an amount of about 0 to about 20% by weight of the composition.

c. Corrosion Inhibitors

Suitable corrosion inhibitors include, but are not limited to, amidoamines, quaternary amines, amides, phosphate esters, and combinations thereof. The amount of corrosion inhibitor present in the composition is not particularly limited and may be selected by one of ordinary skill in the art. In some embodiments, the corrosion inhibitor may be present in the composition in an amount of about 0 to about 10% by weight of the composition.

d. Scale Inhibitors

Suitable scale inhibitors include, but are not limited to, phosphates, phosphate esters, phosphoric acids, phosphonates, phosphonic acids, polyacrylamides, salts of acrylamido-methyl propane sulfonate/acrylic acid copolymer (AMPS/AA), phosphinated maleic copolymer (PHOS/MA), salts of a polymaleic acid/acrylic acid/acrylamido-methyl propane sulfonate terpolymer (PMA/AMPS), and combinations thereof. The amount of scale inhibitor present in the composition is not particularly limited and may be selected by one of ordinary skill in the art. In some embodiments, the scale inhibitor may be present in the composition in an amount of about 0 to about 5% by weight of the composition.

e. Emulsifiers

Suitable emulsifiers include, but are not limited to, salts of carboxylic acids, products of acylation reactions between carboxylic acids or carboxylic anhydrides and amines, alkyl, acyl and amide derivatives of saccharides (alkyl-saccharide emulsifiers), and combinations thereof. The amount of emulsifier present in the composition is not particularly limited and may be selected by one of ordinary skill in the art. In some embodiments, the emulsifier may be present in the composition in an amount of about 0 to about 10% by weight of the composition.

f. Water Clarifiers

Suitable water clarifiers include, but are not limited to, inorganic metal salts such as alum, aluminum chloride, and aluminum chlorohydrate, or organic polymers such as acrylic acid based polymers, acrylamide based polymers, polymerized amines, alkanolamines, thiocarbamates, cationic polymers such as diallyldimethylammonium chloride (DADMAC), and combinations thereof. The amount of water clarifier present in the composition is not particularly limited and may be selected by one of ordinary skill in the art. In some embodiments, the water clarifier may be present in the composition in an amount of about 0 to about 5% by weight of the composition.

g. Dispersants

Suitable dispersants include, but are not limited to, aliphatic phosphonic acids with 2-50 carbons, such as hydroxyethyl diphosphonic acid, and aminoalkyl phosphonic acids, e.g. polyaminomethylene phosphonates with 2-10 N atoms e.g. each bearing at least one methylene phosphonic acid group; examples of the latter are ethylenediamine tetra(methylene phosphonate), diethylenetriamine penta(methylene phosphonate) and the triamine- and tetramine-polymethylene phosphonates with 2-4 methylene groups between each N atom, at least 2 of the numbers of methylene groups in each phosphonate being different. Other suitable dispersion agents include lignin or derivatives of lignin such as lignosulfonate and naphthalene sulfonic acid and derivatives, and combinations thereof. The amount of dispersant present in the composition is not particularly limited and may be selected by one of ordinary skill in the art. In some embodiments, the dispersant may be present in the composition in an amount of about 0 to about 5% by weight of the composition.

h. Emulsion Breakers

Suitable emulsion breakers include, but are not limited to, dodecylbenzylsulfonic acid (DDBSA), the sodium salt of xylenesulfonic acid (NAXSA), epoxylated and propoxylated compounds, anionic cationic and nonionic surfactants, resins such as phenolic and epoxide resins, and combinations thereof. The amount of emulsion breaker present in the composition is not particularly limited and may be selected by one of ordinary skill in the art. In some embodiments, the emulsion breaker may be present in the composition in an amount of about 0 to about 10% by weight of the composition.

i. Other Hydrogen Sulfide Scavengers

Suitable other hydrogen sulfide scavengers include, but are not limited to, oxidants (e.g., inorganic peroxides such as sodium peroxide, or chlorine dioxide), aldehydes (e.g., of 1-10 carbons such as formaldehyde or glutaraldehyde or (meth)acrolein), triazines (e.g., monoethanol amine triazine, monomethylamine triazine, and triazines from multiple amines or mixtures thereof), glyoxal, and combinations thereof. The amount of other hydrogen sulfide scavengers present in the composition is not particularly limited and may be selected by one of ordinary skill in the art. In some embodiments, the other hydrogen sulfide scavengers may be present in the composition in an amount of about 0 to about 50% by weight of the composition.

j. Gas Hydrate Inhibitors

Suitable gas hydrate inhibitors include, but are not limited to, thermodynamic hydrate inhibitors (THI), kinetic hydrate inhibitors (KHI), anti-agglomerates (AA), and combinations thereof. Suitable thermodynamic hydrate inhibitors include, but are not limited to, NaCl salt, KCl salt, $CaCl_2$ salt, $MgCl_2$ salt, $NaBr_2$ salt, formate brines (e.g. potassium formate), polyols (such as glucose, sucrose, fructose, maltose, lactose, gluconate, monoethylene glycol, diethylene glycol, triethylene glycol, mono-propylene glycol, dipropylene glycol, tripropylene glycols, tetrapropylene glycol, monobutylene glycol, dibutylene glycol, tributylene glycol, glycerol, diglycerol, triglycerol, and sugar alcohols (e.g. sorbitol, mannitol)), methanol, propanol, ethanol, glycol ethers (such as diethyleneglycol monomethylether, ethyleneglycol monobutylether), alkyl or cyclic esters of alcohols (such as ethyl lactate, butyl lactate, methylethyl benzoate), and combinations thereof. Suitable kinetic hydrate inhibitors and anti-agglomerates include, but are not limited to, polymers and copolymers, polysaccharides (such as hydroxy-ethylcellulose (HEC), carboxymethylcellulose (CMC), starch, starch derivatives, and xanthan), lactams (such as polyvinylcaprolactam, polyvinyl lactam), pyrrolidones (such as polyvinyl pyrrolidone of various molecular weights), surfactants (such as fatty acid salts, ethoxylated alcohols, propoxylated alcohols, sorbitan esters, ethoxylated sorbitan esters, polyglycerol esters of fatty acids, alkyl glucosides, alkyl polyglucosides, alkyl sulfates, alkyl sulfonates, alkyl ester sulfonates, alkyl aromatic sulfonates, alkyl betaine, alkyl amido betaines), hydrocarbon based dispersants (such as lignosulfonates, iminodisuccinates, polyaspartates), amino acids, proteins, and combinations thereof. The amount of gas hydrate inhibitor present in the composition is not particularly limited and may be selected by one of ordinary skill in the art. In some embodiments, the gas hydrate inhibitor may be present in the composition in an amount of about 0 to about 5% by weight of the composition.

k. Biocides

Suitable biocides include, but are not limited to, oxidizing and non-oxidizing biocides. Suitable non-oxidizing biocides include, for example, aldehydes (e.g., formaldehyde, glutaraldehyde, and acrolein), amine-type compounds (e.g., quaternary amine compounds and cocodiamine), halogenated compounds (e.g., bronopol and 2-2-dibromo-3-nitrilopropionamide (DBNPA)), sulfur compounds (e.g., isothiazolone, carbamates, and metronidazole), quaternary phosphonium salts (e.g., tetrakis(hydroxymethyl)phosphonium sulfate (THPS)), and combinations thereof. Suitable oxidizing biocides include, for example, sodium hypochlorite, trichloroisocyanuric acids, dichloroisocyanuric acid, calcium hypochlorite, lithium hypochlorite, chlorinated hydantoins, stabilized sodium hypobromite, activated sodium bromide, brominated hydantoins, chlorine dioxide, ozone, peroxides, and combinations thereof. The amount of biocide present in the composition is not particularly limited and may be selected by one of ordinary skill in the art. In some embodiments, the biocide may be present in the composition in an amount of about 0 to about 5% by weight of the composition.

l. pH Modifiers

Suitable pH modifiers include, but are not limited to, alkali hydroxides, alkali carbonates, alkali bicarbonates, alkaline earth metal hydroxides, alkaline earth metal carbonates, alkaline earth metal bicarbonates and mixtures or combinations thereof. Exemplary pH modifiers include NaOH, KOH, $Ca(OH)_2$, CaO, $Na_2CO_3$, $KHCO_3$, $K_2CO_3$, $NaHCO_3$, MgO, and $Mg(OH)_2$. The amount of pH modifier present in the composition is not particularly limited and may be selected by one of ordinary skill in the art. In some embodiments, the pH modifier may be present in the composition in an amount of about 0 to about 10% by weight of the composition.

m. Surfactants

Suitable surfactants include, but are not limited to, anionic surfactants, cationic surfactants, nonionic surfactants, and combinations thereof. Anionic surfactants include alkyl aryl sulfonates, olefin sulfonates, paraffin sulfonates, alcohol sulfates, alcohol ether sulfates, alkyl carboxylates and alkyl ether carboxylates, and alkyl and ethoxylated alkyl phosphate esters, and mono and dialkyl sulfosuccinates and sulfosuccinamates, and combinations thereof. Cationic surfactants include alkyl trimethyl quaternary ammonium salts, alkyl dimethyl benzyl quaternary ammonium salts, dialkyl dimethyl quaternary ammonium salts, imidazolinium salts, and combinations thereof. Nonionic surfactants include alcohol alkoxylates, alkylphenol alkoxylates, block copolymers of ethylene, propylene and butylene oxides, alkyl dimethyl amine oxides, alkyl-bis(2-hydroxyethyl) amine oxides, alkyl amidopropyl dimethyl amine oxides, alkylamidopropyl-bis(2-hydroxyethyl) amine oxides, alkyl polyglucosides, polyalkoxylated glycerides, sorbitan esters and polyalkoxylated sorbitan esters, and alkoyl polyethylene glycol esters and diesters, and combinations thereof. Also included are betaines and sultanes, amphoteric surfactants such as alkyl amphoacetates and amphodiacetates, alkyl amphopropripionates and amphodipropionates, alkyliminodiproprionate, and combinations thereof.

In certain embodiments, the surfactant may be a quaternary ammonium compound, an amine oxide, an ionic or non-ionic surfactant, or any combination thereof. Suitable quaternary amine compounds include, but are not limited to, alkyl benzyl ammonium chloride, benzyl cocoalkyl($C_{12}$-$C_{18}$)dimethylammonium chloride, dicocoalkyl ($C_{12}$-$C_{18}$)dimethylammonium chloride, ditallow dimethylammonium chloride, di(hydrogenated tallow alkyl)dimethyl quaternary ammonium methyl chloride, methyl bis(2-hydroxyethyl cocoalkyl($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, and hydrogenated tallow alkyl (2-ethylhyexyl) dimethyl quaternary ammonium methyl sulfate. The amount of surfactant present in the composition is not particularly limited and may be selected by one of ordinary skill in the art. In some embodiments, the surfactant may be present in the composition in an amount of about 0 to about 10% by weight of the composition.

n. Solvents

Suitable solvents include, but are not limited to, water, isopropanol, methanol, ethanol, 2-ethylhexanol, heavy aromatic naphtha, toluene, ethylene glycol, ethylene glycol monobutyl ether (EGMBE), diethylene glycol monoethyl ether, xylene, and combinations thereof. In some embodiments, the solvent is toluene. In some embodiments, the solvent is naphtha. Representative polar solvents suitable for formulation with the composition include water, brine, seawater, alcohols (including straight chain or branched aliphatic such as methanol, ethanol, propanol, isopropanol, butanol, 2-ethylhexanol, hexanol, octanol, decanol, 2-butoxyethanol, etc.), glycols and derivatives (ethylene glycol, 1,2-propylene glycol, 1,3-propylene glycol, ethylene glycol monobutyl ether, etc.), ketones (cyclohexanone, diisobutylketone), N-methylpyrrolidinone (NMP), N,N-dimethylformamide and the like. Representative of non-polar solvents suitable for formulation with the composition include aliphatics such as pentane, hexane, cyclohexane, methylcyclohexane, heptane, decane, dodecane, diesel, and the like; aromatics such as toluene, xylene, heavy aromatic naphtha, fatty acid derivatives (acids, esters, amides), and the like.

In certain embodiments, the solvent is a polyhydroxylated solvent, a polyether, an alcohol, or a combination thereof.

In some embodiments, the solvent is monoethyleneglycol, methanol, dimethyl sulfoxide (DMSO), dimethylformamide (DMF), tetrahydrofuran (THF), or a combination thereof.

In some embodiments, a composition disclosed herein comprises from 0 to about 80 percent by weight of one or more solvents, based on the weight of the composition. In some embodiments, a composition of the invention comprises from 0 to about 50 percent by weight of one or more solvents, based on the weight of the composition. In certain embodiments, a composition comprises 20%, 25%, 30%, 35%, 40%, 45%, or 50% by weight of one or more solvents, based on the weight of the composition.

o. Additional Components

Compositions disclosed herein may further include additional functional agents or additives that provide a beneficial property. Additional agents or additives will vary according to the particular scavenging composition being manufactured and its intended use as one skilled in the art will appreciate. According to one embodiment, the scavenging compositions do not contain any of the additional agents or additives. The amount of additional components present in the composition is not particularly limited and may be selected by one of ordinary skill in the art. In some embodiments, the additional components may be present in the composition in an amount of about 0 to about 90% by weight of the composition.

4. Methods of Use

The compounds and compositions disclosed herein may be used for sweetening a gas or liquid, such as a sour gas or a sour liquid. The compounds and compositions may be used for scavenging hydrogen sulfide and/or mercaptans from a gas or liquid stream by treating the stream with an effective amount of a compound or composition described herein. The compounds and compositions can be used in any industry where it is desirable to capture hydrogen sulfide and/or mercaptans from a gas or liquid stream. In certain embodiments, the compounds and compositions can be used in water systems, condensate/oil systems/gas systems, or any combination thereof. In certain embodiments, the compounds and compositions can be applied to a gas or liquid produced or used in the production, transportation, storage, and/or separation of crude oil or natural gas. In some embodiments, the compounds and compositions can be applied to a gas stream used or produced in a coal-fired process, such as a coal-fired power plant. In certain embodiments, the compounds and compositions can be applied to a gas or liquid produced or used in a waste-water process, a farm, a slaughter house, a land-fill, a municipality waste-water plant, a coking coal process, or a biofuel process.

The compounds and compositions may be added to any fluid or gas containing hydrogen sulfide and/or a mercaptan, or a fluid or gas that may be exposed to hydrogen sulfide and/or a mercaptan. A fluid to which the compounds and compositions may be introduced may be an aqueous medium. The aqueous medium may comprise water, gas, and optionally liquid hydrocarbon. A fluid to which the compounds and compositions may be introduced may be a liquid hydrocarbon. The liquid hydrocarbon may be any type of liquid hydrocarbon including, but not limited to, crude oil, heavy oil, processed residual oil, bituminous oil, coker oils, coker gas oils, fluid catalytic cracker feeds, gas oil, naphtha, fluid catalytic cracking slurry, diesel fuel, fuel oil, jet fuel, gasoline, and kerosene. In some embodiments, the gas may be a sour gas. In some embodiments, the fluid or gas may be a refined hydrocarbon product.

A fluid or gas treated with a compound or composition of the invention may be at any selected temperature, such as ambient temperature or an elevated temperature. In some embodiments, the fluid (e.g., liquid hydrocarbon) or gas may be at a temperature of from about 40° C. to about 250° C. In some embodiments, the fluid or gas may be at a temperature of from −50° C. to 300° C., 0° C. to 200° C., 10° C. to 100° C., or 20° C. to 90° C. In some embodiments, the fluid or gas may be at a temperature of 22° C., 23° C., 24° C., 25° C., 26° C., 27° C., 28° C., 29° C., 30° C., 31° C., 32° C., 33° C., 34° C., 35° C., 36° C., 37° C., 38° C., 39° C., or 40° C. In some embodiments, the fluid or gas may be at a temperature of 85° C., 86° C., 87° C., 88° C., 89° C., 90° C., 91° C., 92° C., 93° C., 94° C., 95° C., 96° C., 97° C., 98° C., 99° C., or 100° C.

The fluid or gas in which the compounds and compositions are introduced may be contained in and/or exposed to many different types of apparatuses. For example, the fluid or gas may be contained in an apparatus that transports fluid or gas from one point to another, such as an oil and/or gas pipeline. In certain embodiments, the apparatus may be part of an oil and/or gas refinery, such as a pipeline, a separation vessel, a dehydration unit, or a gas line. The fluid may be contained in and/or exposed to an apparatus used in oil extraction and/or production, such as a wellhead. The apparatus may be part of a coal-fired power plant. The apparatus may be a scrubber (e.g., a wet flue gas desulfurizer, a spray dry absorber, a dry sorbent injector, a spray tower, a contact or bubble tower, or the like). The apparatus may be a cargo vessel, a storage vessel, a holding tank, or a pipeline connecting the tanks, vessels, or processing units. In certain embodiments, the fluid or gas may be contained in water systems, condensate/oil systems/gas systems, or any combination thereof.

The compounds or compositions may be introduced into a fluid or gas by any appropriate method for ensuring dispersal of the scavenger through the fluid or gas. The compounds and compositions may be injected using mechanical equipment such as chemical injection pumps, piping tees, injection fittings, atomizers, quills, and the like. The compounds and compositions of the invention may be introduced with or without one or more additional polar or non-polar solvents depending upon the application and requirements. In some embodiments, the compounds and compositions may be pumped into an oil and/or gas pipeline using an umbilical line. In some embodiments, capillary injection systems can be used to deliver the compounds and compositions to a selected fluid. In some embodiments, the compounds and compositions can be introduced into a liquid and mixed. In some embodiments, the compounds and compositions can be injected into a gas stream as an aqueous or nonaqueous solution, mixture, or slurry. In some embodiments, the fluid or gas may be passed through an absorption tower comprising a compound or composition.

The compounds and compositions may be applied to a fluid or gas at to provide a scavenger concentration of about 1 parts per million (ppm) to about 1,000,000 ppm, about 1 parts per million (ppm) to about 100,000 ppm, about 10 ppm to about 75,000 ppm, about 100 ppm to about 45,000 ppm, about 500 ppm to about 40,000 ppm, about 1,000 ppm to about 35,000 ppm, about 3,000 ppm to about 30,000 ppm, about 4,000 ppm to about 25,000 ppm, about 5,000 ppm to about 20,000 ppm, about 6,000 ppm to about 15,000 ppm, or about 7,000 ppm to about 10,000 ppm. The compounds and compositions may be applied to a fluid at a concentration of about 100 ppm to about 2,000 ppm, about 200 ppm to about 1,500 ppm, or about 500 ppm to about 1000 ppm. Each system may have its own requirements, and a more sour gas (e.g., containing more hydrogen sulfide) may require a higher dose rate of a compound or composition. In some embodiments, the compounds and compositions may be applied to a fluid or gas in an equimolar amount or greater relative to hydrogen sulfide and/or mercaptans present in the fluid or gas. In some embodiments, the compounds and compositions may be applied to a fluid or gas as a neat composition (e.g., the compounds and compositions may be used neat in a contact tower).

The hydrogen sulfide and/or mercaptan in a fluid or gas may be reduced by any amount by treatment with a compound or composition. The actual amount of residual hydrogen sulfide and/or mercaptan after treatment may vary depending on the starting amount. In some embodiments, the hydrogen sulfide and/or mercaptan levels may be reduced to about 150 ppm by volume or less, as measured in the vapor phase, based on the volume of the liquid media. In some embodiments, the hydrogen sulfide levels and/or mercaptan may be reduced to 100 ppm by volume or less, as measured in the vapor phase, based on the volume of the liquid media. In some embodiments, the hydrogen sulfide and/or mercaptan levels may be reduced to 50 ppm by volume or less, as measured in the vapor phase, based on the volume of the liquid media. In some embodiments, the hydrogen sulfide and/or mercaptan levels may be reduced to 20 ppm by volume or less, as measured in the vapor phase, based on the volume of the liquid media. In some embodiments, the hydrogen sulfide and/or mercaptan levels may be reduced to 15 ppm by volume or less, as measured in the vapor phase, based on the volume of the liquid media. In some embodiments, the hydrogen sulfide and/or mercaptan levels may be reduced to 10 ppm by volume or less, as measured in the vapor phase, based on the volume of the liquid media. In some embodiments, the hydrogen sulfide and/or mercaptan levels may be reduced to 5 ppm by volume or less, as measured in the vapor phase, based on the volume of the liquid media. In some embodiments, the hydrogen sulfide and/or mercaptan levels may be reduced to 1 ppm by volume, as measured in the vapor phase, based on the volume of the liquid media. In some embodiments, the hydrogen sulfide and/or mercaptan levels may be reduced to 0 ppm by volume, as measured in the vapor phase, based on the volume of the liquid media.

In certain embodiments, the compounds and compositions of the invention may be soluble in an aqueous phase such that the captured sulfur-based species will migrate into the aqueous phase. If an emulsion is present, the captured sulfur-based species can be migrated into the aqueous phase from a hydrocarbon phase (e.g., crude oil) and removed with the aqueous phase. If no emulsion is present, a water wash can be added to attract the captured sulfur-based species. In certain embodiments, the compounds and compositions of the invention can be added before a hydrocarbon (e.g., crude oil) is treated in a desalter, which emulsifies the hydrocarbon media with a water wash to extract water soluble contaminants and separates and removes the water phase from the hydrocarbon.

In certain embodiments, a water wash may be added in an amount suitable for forming an emulsion with a hydrocarbon. In certain embodiments, the water wash may be added in an amount of from about 1 to about 50 percent by volume based on the volume of the emulsion. In certain embodiments, the wash water may be added in an amount of from about 1 to about 25 percent by volume based on the volume of the emulsion. In certain embodiments, the wash water may be added in an amount of from about 1 to about 10 percent by volume based on the volume of the emulsion. In certain embodiments, the amount of hydrocarbon may be present in an amount of from about 50 to about 99 percent by volume based on the volume of the emulsion. In some embodiments, the hydrocarbon may be present in an amount of from about 75 to about 99 percent by volume based on the volume of the emulsion. In some embodiments, the hydrocarbon may be present in an amount of from about 90 to about 99 percent by volume based on the volume of the emulsion.

The water wash and hydrocarbon may be emulsified by any conventional manner. In some embodiments, the water wash and hydrocarbon may be heated and thoroughly mixed to produce an oil-in-water emulsion. In certain embodiments, the water wash and hydrocarbon may be heated at a temperature in a range of from about 90° C. to about 150° C. The water wash and hydrocarbon may be mixed in any conventional manner, such as an in-line static mixer or an in-line mix valve with a pressure drop of about 0.2 to about 2 bar depending on the density of the hydrocarbon. The emulsion may be allowed to separate, such as by settling, into an aqueous phase and an oil phase. In certain embodiments, the aqueous phase may be removed. In another embodiment, the aqueous phase may be removed by draining the aqueous phase.

Optionally, demulsifiers may be added to aid in separating water from the hydrocarbon. In certain embodiments, the demulsifiers include, but are not limited to, oxyalkylated organic compounds, anionic surfactants, nonionic surfactants or mixtures of these materials. The oxyalkylated organic compounds include, but are not limited to, phenol-formaldehyde resin ethoxylates and alkoxylated polyols. The anionic surfactants include alkyl or aryl sulfonates, such as dodecylbenzenesulfonate. These demulsifiers may be added in amounts to contact the water from about 1 to about 1000 ppm by weight based on the weight of the hydrocarbon.

The compounds, compositions, methods, and processes will be better understood by reference to the following examples, which are intended as an illustration of and not a limitation upon the scope of the invention.

5. Examples

A hemiformal product is prepared by adding the alcohol to a reaction flask equipped with a magnetic stirrer, a nitrogen inlet, and a temperature probe. The reaction mixture is heated to a temperature of about 80° C. Nitrogen can be swept over the reaction mixture throughout the entire reaction. About 0.001 to about 0.035 molar equivalents of a potassium hydroxide (KOH) solution (45% in water) is added to the reaction flask and the reaction is stirred at about 80° C. for about 20 minutes. Molar equivalents of paraformaldehyde prills (91% activity) is added to the reaction mixture batch-wise using, for example, a solid addition funnel. The number of molar equivalents depends upon the number of alcohol groups in the alcohol and the number of hemiformal units (i.e. x, y, or z) desired. After all paraformaldehyde has been added, the reaction mixture is heated for about 2 to 4 hours at temperature of about 80° C. to produce the desired scavenger compound.

In some embodiments, the paraformaldehyde is added at a rate of about 5 to 10 grams every 10 minutes. After all paraformaldehyde has been added, the reaction mixture may be heated for about 2 to 4 hours at 60° C.-80° C. to produce the desired scavenger compound.

Example 1

The hemiformal condensation product of 2-butyl-2-ethyl-1,3-propanediol was prepared by adding the alkyldiol (100 g, 0.62 moles) to a reaction flask equipped with a magnetic stirrer, a nitrogen inlet, and a temperature probe. The reaction mixture was heated to a temperature of about 80° C. Nitrogen was swept over the reaction mixture throughout the entire reaction. About 0.025 moles of a potassium hydroxide (KOH) solution (45% in water) was added to the reaction flask, and the reaction was stirred at about 80° C. for about 20 minutes. About 1.24 moles, 41 grams of solid paraformaldehyde prills (91% activity) was added to the reaction mixture batch-wise using, for example, a solid addition funnel. After all paraformaldehyde has been added, the reaction mixture is heated for about 2 to 4 hours at temperature of about 80° C. to produce the scavenger compound (((2-butyl-2-ethylpropane-1,3-diyl)bis(oxy))dimethanol).

Example 2

1 mole (0.74 moles, 100 g) of 1,1,1-tris(hydroxymethyl) propane (TMP) was added to a reaction flask. The flask was heated to 70° C., and KOH (2% of 45% active KOH) was added. This solution was then stirred and heated for another 20-25 minutes at 70° C. followed by addition of paraformaldehyde (2.22 moles, 73.26 g). Upon complete addition of paraformaldehyde, the reaction mixture was maintained at 75° C. for 3 hours. Nitrogen purge was used throughout the reaction. The resulting hemiformal scavenger compound was characterized as ((2-ethyl-2-((hydroxymethoxy)methyl) propane-1,3-diyl)bis(oxy))dimethanol.

Comparative Example 1

The hemiformal condensation product of 1-octanol was prepared by adding 0.47 moles (61.92 g) of 1-octanol to a reaction flask equipped with a magnetic stirrer, a nitrogen inlet, and a temperature probe. The flask was heated to a temperature of about 80° C. Nitrogen was swept over the reaction mixture throughout the entire reaction. About 0.001 to about 0.035 (1.70 g) moles of a potassium hydroxide (KOH) solution (45% in water) was added to the reaction flask, and the reaction was stirred at about 80° C. for about 20 minutes. About 38.08 grams of formalin solution (37.5% activity) was added to the reaction mixture batch-wise using a solid addition funnel. After all formalin has been added, the reaction mixture is heated for about 2 to 4 hours at temperature of about 80° C. to produce the comparative compound (octyloxy)methanol.

Comparative Example 2

The hemiformal condensation product of 2-ethylhexanol was prepared by adding 80 grams 2-ethylhexanol to a reaction flask equipped with a magnetic stirrer, a nitrogen inlet, and a temperature probe. The flask was heated to a temperature of about 80° C. Nitrogen was swept over the reaction mixture throughout the entire reaction. About 0.035 moles of a potassium hydroxide (KOH) solution (45% in water) was added to the reaction flask, and the reaction was stirred at about 80° C. for about 20 minutes. About 20 grams of solid paraformaldehyde prills (91% activity) was added to the reaction mixture batch-wise using a solid addition funnel. After all paraformaldehyde has been added, the reaction mixture is heated for about 2 to 4 hours at temperature of about 80° C. to produce the comparative compound ((2-ethylhexyl)oxy)methanol.

The performance of scavengers was measured from hydrogen sulfide content in a liquid phase. This method is very similar to a vapor phase method except that the hydrogen sulfide level in the liquid phase is measured with a titration method.

A known amount of hydrocarbon (LVT-200, Geo Drilling Fluids, Inc. 1431 Union Ave. Bakersfield, Calif. 93305) was purged with a of hydrogen sulfide gas which is then transferred to a glass vessel with the selected scavenger. The glass bottle was then heated to a temperature of 60 to 80° C. in a dynamic box for time based on retention time of 1 hour in field. The contents (i.e. the sulfide content in the hydrocarbon solution) are then measured using a titration. The results are identified in Table I.

TABLE I

| Scavenger based on | Fluid volume (mL) | Dosage ratio (Scavenger:$H_2S$ ppm) | Dosage (μL) | Starting $H_2S$ (ppm) | Ending $H_2S$ (ppm) | Removed $H_2S$ (ppm) | % $H_2S$ Removed (ppm) |
|---|---|---|---|---|---|---|---|
| Untreated | 100 | 0 | 0 | 71.48 | 71.48 | 0 | 0 |
| Comparative Example 1 | 100 | 10.1 | 70 | 71.48 | 42.89 | 28.59 | 40 |
| Comparative Example 2 | 100 | 10.1 | 70 | 71.48 | 35.74 | 35.74 | 50 |
| Example 1 | 100 | 10.1 | 70 | 71.48 | 21 | 50.48 | 70 |
| Example 2 | 100 | 10:1 | 70 | 71.48 | 19.32 | 52.16 | 73 |

Analysis of the scavenger's ability to scavenge hydrogen sulfide in kerosene mixed with water was examined. The results are shown in Table II for 30% BSW (basic sediment and water) and 70% BSW using the hemiformal product of Example 2 tested in Table I at 1000 ppm, 70° C., and at pressure of 150 psi.

TABLE II

| % BSW | Liters of scavenger/Kg of $H_2S$ | G of $H_2S$/L of scavenger |
|---|---|---|
| 30 | 18.37 | 54.44 |
| 70 | 28.47 | 35.13 |

From the data in Table II, it can be seen that the lesser product (18.37 L/Kg) is needed to scavenge $H_2S$ from the fluids with 30% BSW demonstrating more partitioning behavior in the scavenger in the hydrocarbon phase.

Without wishing to be bound to any theory, it is believed that the hemiformals' increased miscibility in the hydrocarbon contributes to its improved sulfide scavenging activity. In contrast, glyoxal's sulfide scavenging activity is lower because of its poor oil solubility.

The invention encompasses any and all possible combinations of some or all of the various embodiments described herein. Any and all patents, patent applications, scientific papers, and other references cited in this application, as well as any references cited therein, are hereby incorporated by reference in their entirety.

What is claimed is:

1. A method of scavenging hydrogen sulfide from a hydrocarbon fluid, comprising:

treating the hydrocarbon fluid with an oil-soluble hemiformal selected from the group consisting of ((((2-butyl-2-ethylpropane-1,3-diyl)bis(oxy))dimethanol, 2-ethyl-2-((hydroxymethoxy)methyl)propane-1,3-diyl) bis(oxy))dimethanol, (octyloxy)methanol, ((2-ethylhexyl)oxy)methanol, and any combination thereof, and reducing an amount of hydrogen sulfide in the hydrocarbon fluid.

2. The method of claim 1, further comprising adding one or more additional components, each component independently selected from the group consisting of asphaltene inhibitors, paraffin inhibitors, corrosion inhibitors, scale inhibitors, emulsifiers, water clarifiers, dispersants, emulsion breakers, hydrogen sulfide scavengers, gas hydrate inhibitors, biocides, pH modifiers, surfactants, dispersant, solvents, and combinations thereof.

3. The method of claim 2, wherein the surfactant or dispersant is selected from the group consisting alkyl benzyl ammonium chloride, benzyl cocoalkyl($C_{12}$-$C_{18}$)dimethylammonium chloride, dicocoalkyl ($C_{12}$-$C_{18}$)dimethylammonium chloride, ditallow dimethylammonium chloride, di(hydrogenated tallow alkyl)dimethyl quaternary ammonium methyl chloride, methyl bis(2-hydroxyethyl cocoalkyl($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, hydrogenated tallow alkyl (2-ethylhyexyl) dimethyl quaternary ammonium methyl sulfate, and combinations thereof.

4. The method of claim 1, further comprising adding an odorant.

5. The method of claim 1, wherein the hydrocarbon fluid is produced or used in a coal-fired process, a waste-water process, a farm, a slaughter house, a land-fill, a municipality waste-water plant, a coking coal process, or a biofuel process.

6. A method of scavenging hydrogen sulfide from a hydrocarbon fluid, comprising:

treating the hydrocarbon fluid with an oil-soluble hemiformal selected from the group consisting of ((((2-butyl-2-ethylpropane-1,3-diyl)bis(oxy))dimethanol, 2-ethyl-2-((hydroxymethoxy)methyl)propane-1,3-diyl) bis(oxy))dimethanol, and any combination thereof, and reducing an amount of hydrogen sulfide in the hydrocarbon fluid.

7. The method of claim 6, further comprising adding one or more additional components, each component independently selected from the group consisting of asphaltene inhibitors, paraffin inhibitors, corrosion inhibitors, scale inhibitors, emulsifiers, water clarifiers, dispersants, emulsion breakers, hydrogen sulfide scavengers, gas hydrate inhibitors, biocides, pH modifiers, surfactants, dispersant, solvents, and combinations thereof.

8. The method of claim 7, wherein the surfactant or dispersant is selected from the group consisting alkyl benzyl ammonium chloride, benzyl cocoalkyl($C_{12}$-$C_{18}$)dimethylammonium chloride, dicocoalkyl ($C_{12}$-$C_{18}$)dimethylammonium chloride, ditallow dimethylammonium chloride, di(hydrogenated tallow alkyl)dimethyl quaternary ammonium methyl chloride, methyl bis(2-hydroxyethyl cocoalkyl($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, hydrogenated tallow alkyl (2-ethylhyexyl) dimethyl quaternary ammonium methyl sulfate, and combinations thereof.

9. The method of claim 6, further comprising adding an odorant.

10. A method of scavenging hydrogen sulfide from sweetening a hydrocarbon fluid, comprising:

treating the hydrocarbon fluid with an oil-soluble hemiformal selected from the group consisting of (octyloxy) methanol, ((2-ethylhexyl)oxy)methanol, and any combination thereof, and reducing an amount of hydrogen sulfide in the hydrocarbon fluid.

11. The method of claim 10, wherein the oil-soluble hemiformal is ((2-ethylhexyl)oxy)methanol.

12. The method of claim 10, further comprising adding one or more additional components, each component independently selected from the group consisting of asphaltene inhibitors, paraffin inhibitors, corrosion inhibitors, scale inhibitors, emulsifiers, water clarifiers, dispersants, emulsion breakers, hydrogen sulfide scavengers, gas hydrate inhibitors, biocides, pH modifiers, surfactants, dispersant, solvents, and combinations thereof.

13. The method of claim 12, wherein the surfactant or dispersant is selected from the group consisting alkyl benzyl ammonium chloride, benzyl cocoalkyl($C_{12}$-$C_{18}$)dimethylammonium chloride, dicocoalkyl ($C_{12}$-$C_{18}$)dimethylammonium chloride, ditallow dimethylammonium chloride, di(hydrogenated tallow alkyl)dimethyl quaternary ammonium methyl chloride, methyl bis(2-hydroxyethyl cocoalkyl($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, hydrogenated tallow alkyl (2-ethylhyexyl) dimethyl quaternary ammonium methyl sulfate, and combinations thereof.

* * * * *